US006539886B2

(12) United States Patent
Henry et al.

(10) Patent No.: US 6,539,886 B2
(45) Date of Patent: Apr. 1, 2003

(54) INTEGRATED LIGHT AND TOW-LINE-ATTACHMENT ASSEMBLY FOR A BOAT

(75) Inventors: Keith P. Henry, Maryville, TN (US); Darren S. Sheedy, Greenback, TN (US)

(73) Assignee: MasterCraft Boat Company, Inc., Vonore, TN (US)

( * ) Notice: Subject to any disclaimer, the term of this patent is extended or adjusted under 35 U.S.C. 154(b) by 0 days.

(21) Appl. No.: 10/118,075

(22) Filed: Apr. 9, 2002

(65) Prior Publication Data

US 2002/0189521 A1 Dec. 19, 2002

Related U.S. Application Data

(63) Continuation-in-part of application No. 29/143,459, filed on Jun. 15, 2001, now Pat. No. Des. 455,853.

(51) Int. Cl.[7] ..... B63B 21/04

(52) U.S. Cl. ..... 114/253; 114/343; 114/364

(58) Field of Search ..... 114/343, 364, 114/221 R, 218, 253; 364/559; D26/28; 362/61, 80, 82, 83, 267, 307, 311, 330–340, 362, 81

(56) References Cited

U.S. PATENT DOCUMENTS

| | | | | | |
|---|---|---|---|---|---|
| 1,852,260 | A | * | 4/1932 | Perkins | |
| 3,431,408 | A | | 3/1969 | Roosevelt | 240/7.5 |
| 3,798,631 | A | * | 3/1974 | Langford | |
| 4,627,374 | A | * | 12/1986 | Wright | 114/218 |
| 5,018,474 | A | * | 5/1991 | Jellen | 114/253 |
| 5,216,972 | A | | 6/1993 | Dufrene et al. | 114/218 |
| D367,332 | S | | 2/1996 | Reniger et al. | D26/28 |
| 5,694,337 | A | * | 12/1997 | Macken | 364/559 |
| D400,675 | S | | 11/1998 | Sopko | D26/35 |
| D403,089 | S | | 12/1998 | Arribard | D26/28 |
| D426,005 | S | | 5/2000 | Reniger et al. | D26/28 |
| 6,174,078 | B1 | | 1/2001 | Ohm et al. | 362/477 |
| 6,176,505 | B1 | | 1/2001 | Capik et al. | 280/477 |
| D455,853 | S | * | 4/2002 | Henry et al. | D26/28 |

OTHER PUBLICATIONS

Attwood Marine Products Catalog, p. 55 (at least as early as Jul. 3, 2000).

National Marine Manufacturers Association, Standards Basis ABYC A–16–97 (at least as early as 1997).

MasterCraft Boat Company 2001 brochure (2000).

MasterCraft Boat Company, 1999 brochure (1998).

* cited by examiner

*Primary Examiner*—Ed Swinehart
(74) *Attorney, Agent, or Firm*—Fitzpatrick, Cella, Harper & Scinto

(57) ABSTRACT

A tow-line-attachment assembly for mounting atop a towing structure on a boat includes a tow-line-attachment portion to which a tow line can be connected for towing a water sports performer, and a light portion, disposed above the tow-line-attachment portion, for emitting light. Preferably, the tow-line-attachment assembly also includes a neck portion for connecting the assembly to the towing structure, and the tow-line-attachment portion is a spool-shaped sleeve that is rotatably mounted about the neck portion. Also disclosed is a boat tower including such a tow-line-attachment assembly, and a boat provided with a tower having such an assembly.

29 Claims, 7 Drawing Sheets

INTEGRATED LIGHT AND TOW-LINE-ATTACHMENT ASSEMBLY FOR A BOAT

RELATED APPLICATION

This application is a continuation-in-part of U.S. patent application Ser. No. 29/143,459, filed Jun. 15, 2001, now U.S. Design Pat. No. D455,853.

BACKGROUND OF THE INVENTION

1. Field of the Invention

This invention relates generally to a tow-line-attachment assembly for attaching a tow line thereto, such as can be mounted atop a towing structure on a boat, and, in particular, to a tow-line-attachment assembly that includes a built-in navigation light.

2. Description of the Related Art

The National Marine Manufacturers Association (NMMA) publishes a set of standards and recommended practices for the lighting of vessels under 20 meters in length. The most recent set of standards, published as Standards Basis ABYC A-16-97, specifies various acceptable configurations of navigation lights. In one configuration, for example, a boat may be equipped with (i) separate sidelights, each visible from at least one nautical mile, (ii) a white masthead light, visible from at least two nautical miles, positioned over the fore and aft centerline at a height of at least one meter above the sidelights, and (iii) a white sternlight, visible from at least two nautical miles, positioned as nearly as practicable to the stern. Alternatively, a single white all-round light, positioned over the fore and aft centerline at a height of at least one meter above the sidelights, may be used in lieu of the masthead light and the stern light. The NMMA standards define an all-round light as one that is visible through 360 degrees horizontally.

Prior to the present invention, all-round lights for recreational boats typically were provided atop a pole structure that could be removably installed in a receiving socket near the stern of the boat. U.S. Pat. No. 6,174,078 discloses an example of such a light. Although these pole lights comply with the NMMA standards, they must be removed and stowed whenever the boat is used to tow a water sports performer. Otherwise, the light pole can interfere with the tow line, which usually is attached to either a pylon or a tower near the middle of the boat. Stowing the pole light, of course, takes up valuable storage space aboard the boat, and the tasks of installing and removing the light can be cumbersome, especially in the dark. It would be advantageous, therefore, to have a navigation light which could be left in place during daylight hours—even when towing a water sports performer—and easily activated when dusk sets in.

SUMMARY OF THE INVENTION

The present invention addresses the foregoing shortcomings in the art by providing a tow-line-attachment assembly with a built-in navigation light for mounting atop a towing structure on a boat.

According to one aspect of the present invention, the tow-line-attachment assembly includes a tow-line-attachment portion to which a tow line can be connected for towing a water sports performer, and a light portion, disposed above the attachment portion, for emitting navigation light. Preferably, the tow-line-attachment portion is a sleeve (e.g., a spool-shaped sleeve) that can swivel about a neck portion of the assembly. Alternatively, the tow-line-attachment portion can simply be a fixed post portion of the assembly to which the tow line is connected. Whether the attachment portion is a swivel sleeve or a fixed post, it may optionally carry an eye member through which the tow line can be passed.

In another aspect, the present invention relates to a boat tower including a vertical structure designed for mounting to a boat, and an integrated light and tow-line-attachment assembly mounted atop the vertical structure. The light and tow-line-attachment assembly includes a tow-line-attachment portion to which a tow line can be connected for towing a water sports performer, and a light portion, disposed above the tow-line attachment portion, for emitting navigation light.

In still another aspect, the present invention relates to a boat including a hull having a bow, a stem, and port and starboard sides. The boat also includes a tower mounted to the hull. The tower includes an integrated light and tow-line-attachment assembly, which includes a tow-line attachment portion to which a tow line can be connected for towing a water sports performer, and a light portion, disposed above the tow-line attachment portion, for emitting navigation light.

A better understanding of these and other objects, features, and advantages of the invention may be had by reference to the drawings and to the accompanying description, in which preferred embodiments of the invention are illustrated and described.

BRIEF DESCRIPTION OF THE DRAWINGS

Throughout the figures, like reference numerals have been used for like or corresponding parts.

DESCRIPTION OF THE PREFERRED EMBODIMENTS

Figure 1:
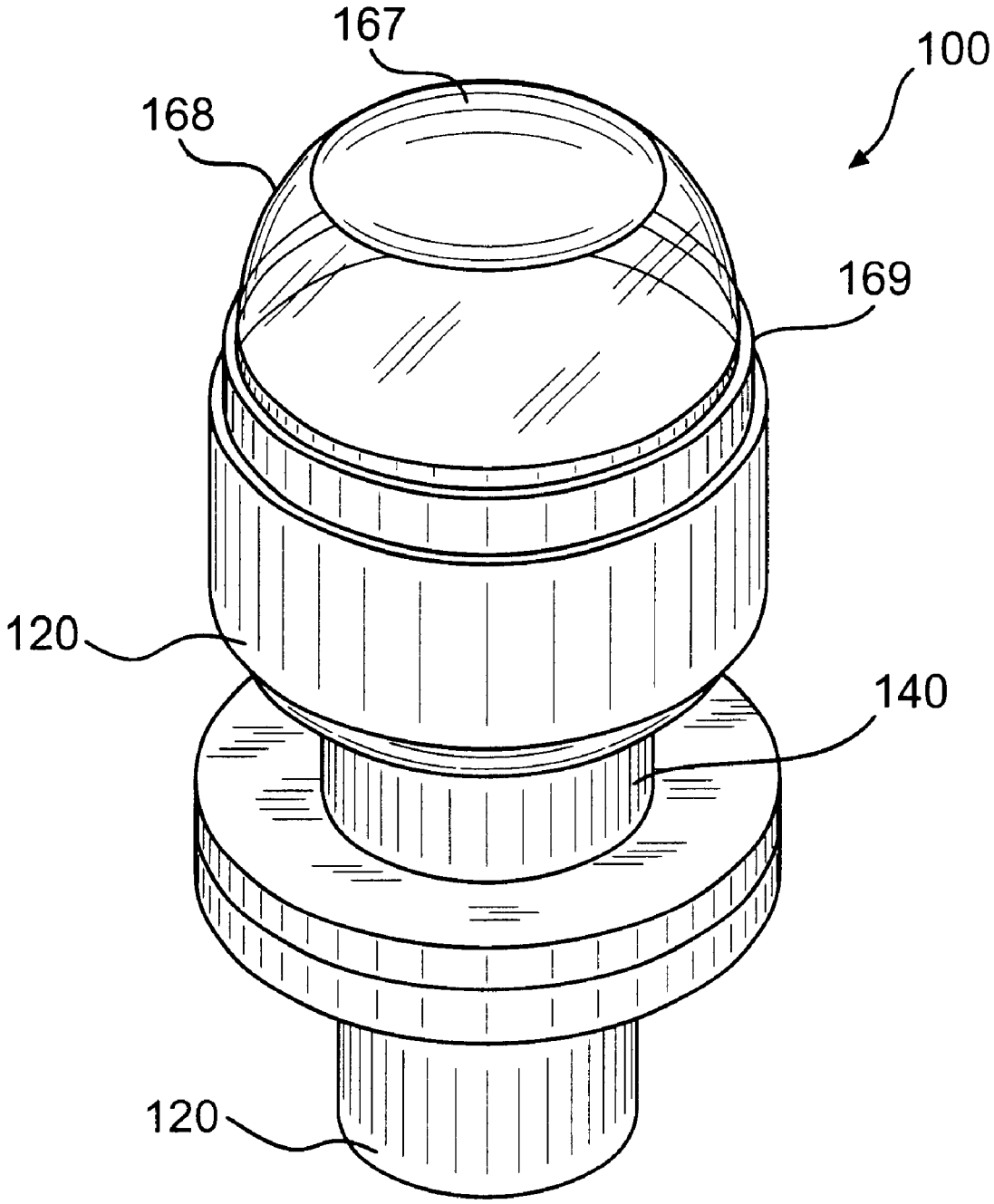
FIG. 1 is a perspective view of a preferred embodiment of the light and tow-line-attachment assembly of the present invention, in which a swivel sleeve is used.
Figure 2:
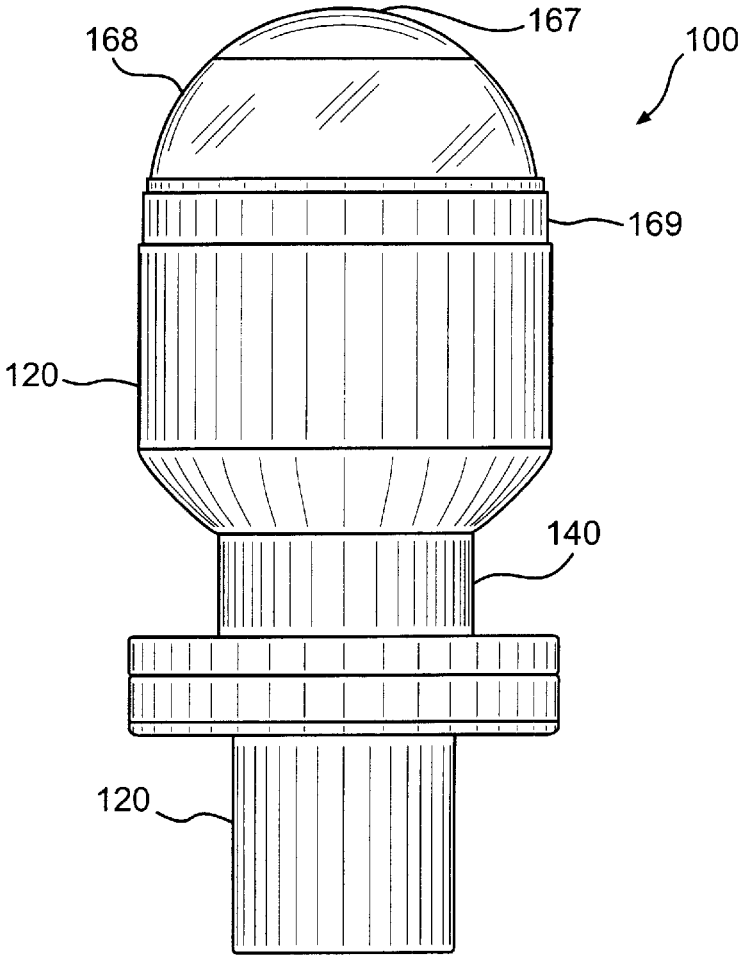
FIG. 2 is a front view of the light and tow-line-attachment assembly shown in FIG. 1.
Figure 3:
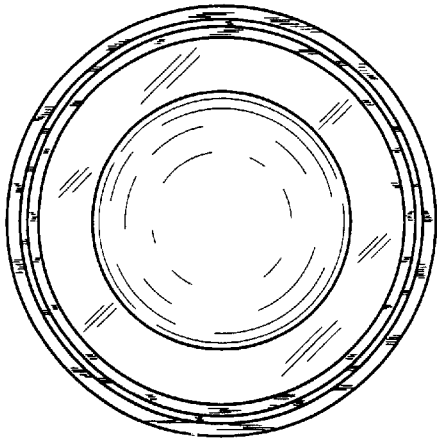
FIG. 3 is a top view of the light and tow-line-attachment assembly shown in FIG. 1.
Figure 4:
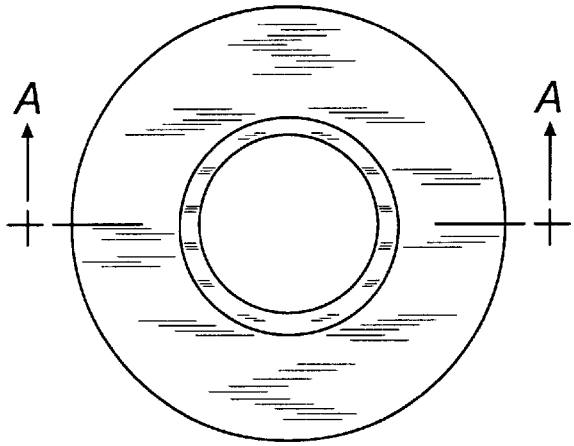
FIG. 4 is a bottom view of the light and tow-line-attachment assembly shown in FIG. 1.

The light and tow-line-attachment assembly of the present invention is suitable for use on any boat that is used to tow a water sports performer, such as a wakeboarder, water skier, kneeboarder, or the like. Preferably, the light and tow-line-attachment assembly is used in connection with boats having towing towers, but it also can be used in connection with boats having other towing structures, such as pylons.

FIGS. 1–6 illustrate a preferred embodiment of a light and tow-line-attachment assembly 100 according to the present invention. In this embodiment, the assembly 100 comprises three main components: a neck portion 120, a tow-line attachment portion 140, and a light portion 160. The neck portion 120 connects the assembly 100 to the towing structure. The tow-line-attachment portion 140 is where the tow line 180 attaches to the assembly 100. The light portion 160 is secured above the tow-line-attachment portion 140 and emits navigation light.

Figure 5:
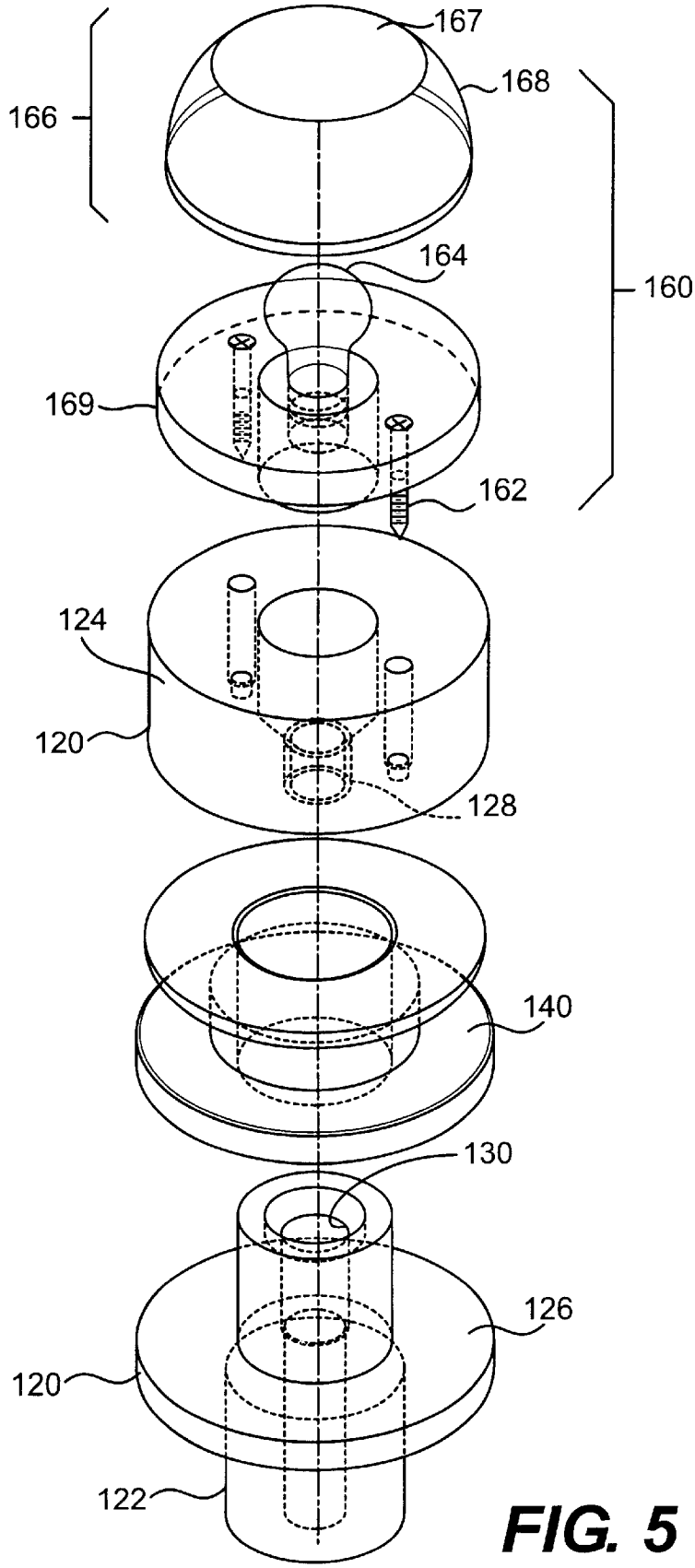
FIG. 5 is an exploded assembly view of the light and tow-line-attachment assembly shown in FIG. 1.
Figure 6:
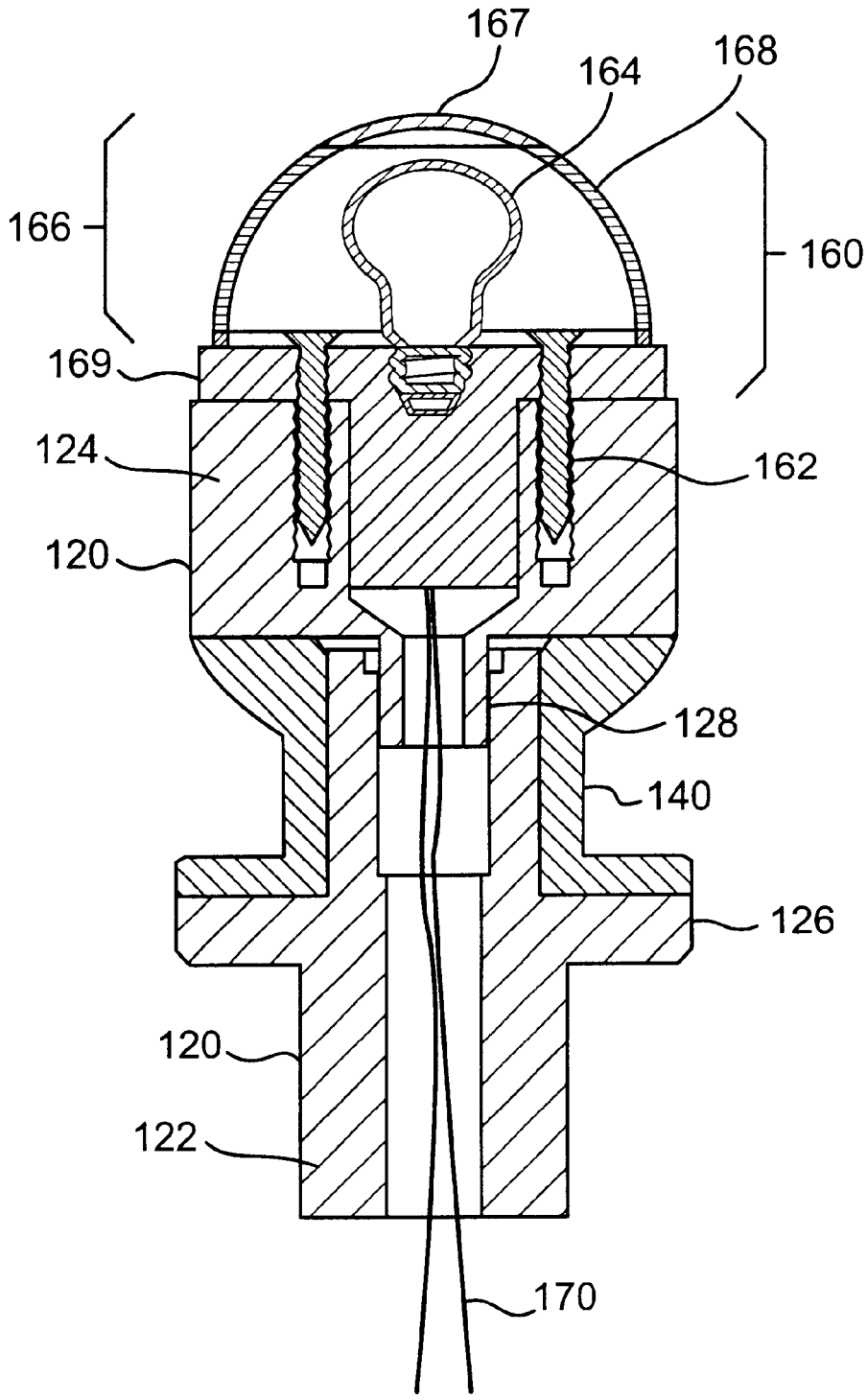
FIG. 6 is a cross-sectional view taken along section line A—A in FIG. 4.

As illustrated in FIGS. 5 and 6, the neck portion 120 comprises first and second generally cylindrical members 122, 124. In the preferred embodiment shown, the tow-line attachment portion is a spool-shaped sleeve 140 that fits over the upper half of the first cylindrical member 122 and rests on a flange or collar 126 thereof. The second cylindrical member 124 contains a male-threaded lower portion 128 that screws into a female-threaded bore 130 in the first cylindrical member. Both the first and second cylindrical members 122, 124 are hollow, thus forming a continuous central passageway along the axis of the neck portion 120.

Preferably, the neck portion 120 is constructed of aluminum. Alternatively, other materials capable of withstanding the stress of towing a water sports performer can be employed, such as stainless steel, titanium alloys, or the like.

Preferably, there is a slight clearance between the inner surface of the sleeve 140 and the outer surface of the first cylindrical member 122 so that the sleeve 140 can swivel about the neck portion 120, but without wobbling. To that end, the sleeve 140 advantageously is constructed of a material that does not cause excessive friction as it swivels about the neck portion 120. Preferred materials for the sleeve 140 are low-friction synthetic resins, e.g., acetal resins, poly(tetrafluoroethylene), nylon, and the like.

In the preferred embodiment shown, the light portion 160 is secured to the upper surface of the second cylindrical member 124 by two fasteners 162, which can be screws, bolts, or other suitable fasteners. The light portion 160 preferably includes a nine-watt, 12-volt light bulb 164 encased within a substantially hemispherical dome 166. The dome 166 comprises a concentrating, circumferential side lens 168 and an opaque cap 167. Preferably, the lens 168 is a Fresnel lens that bends and focuses the light rays into a concentrated ring of light that is visible from a distance of at least two miles away in all horizontal directions. Preferably, the undersurface of the cap 167 is light reflective. The cap 167 is preferably attached to the lens 168 by a waterproof adhesive (not shown). A twist/bayonet lock (not shown) secures the dome 166 to a base 169 of the light portion while allowing for easy removal of the dome 166 in order to replace the light bulb 164 or access the fasteners 162. A suitable all-round light for use as the light portion 160 is available from Atwood Mobile Products of Rockford, Illinois.

In the preferred embodiment of the light and tow-line-attachment assembly described above, the tow-line-attachment portion 140 is a separate piece that swivels about the neck portion 120. Alternatively, the tow-line-attachment portion can be directly mounted to the towing structure and the light portion can be secured to the tow-line-attachment portion, in which case there is no distinct neck portion. Preferably, in this embodiment, the tow-line-attachment portion is constructed of aluminum, stainless steel, a titanium alloy, or the like.

Figure 7:
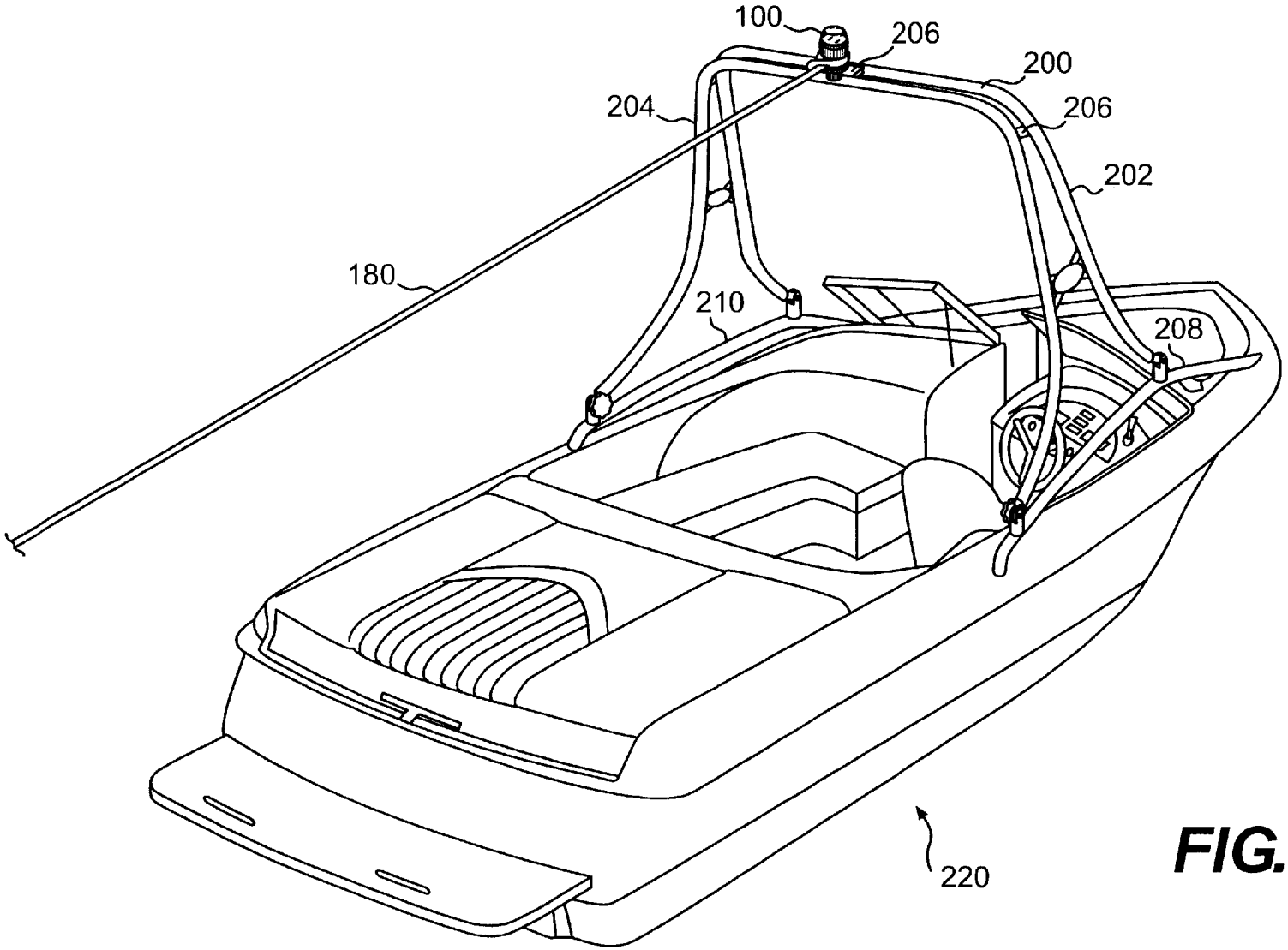
FIG. 7 is a perspective view of the light and tow-line-attachment assembly, mounted atop a boat tower.
Figure 8:
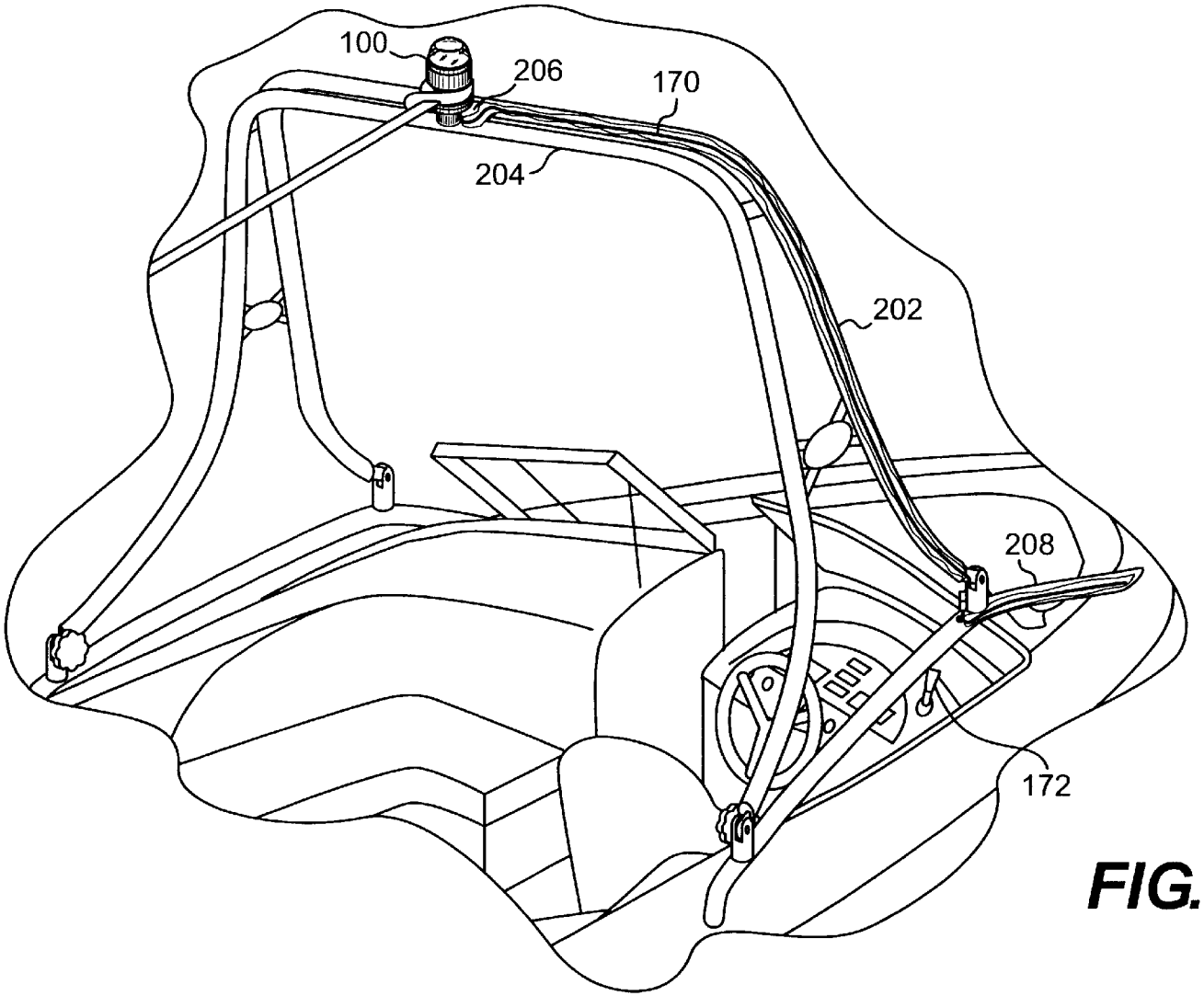
FIG. 8 is a partially cut-away, perspective view of the light and tow-line-attachment assembly, showing the electrical wiring path from the assembly through the tower.

In the preferred embodiment illustrated in FIGS. 7 and 8, the light and tow-line-attachment assembly 100 is mounted atop a tower 200 on a boat 220. The tower 200 comprises a plurality of interconnected tubular members, including forward and aft arches 202, 204, which are joined together by a plurality of horizontal cross members 206, which also are hollow. Each leg of the forward arch 202 is pivotably mounted to a front portion of a different one of two opposing base members 208, 210, which, in the embodiment shown, are secured to the starboard and port sides of the boat 220, respectively. Each leg of the aft arch 204, meanwhile, is detachably mounted to a rear portion of a different one of the opposing base members 208, 210. The tower 200 can be folded downward, toward the bow of the boat 220, by detaching the legs of the aft arch 204 and pivoting the tower 200 about the pivot points at the bottom of the legs of the forward arch 202. Preferably, the tower 200 is constructed of the same material as the neck portion 120 of the light and tow-line-attachment assembly 100, in this case, aluminum. The precise tower structure is not critical to the present invention, however. Indeed, as noted above, the light and tow-line-attachment assembly 100 of the present invention can be utilized in connection with boats having other towing structures, such as pylons and the like.

Figure 9:
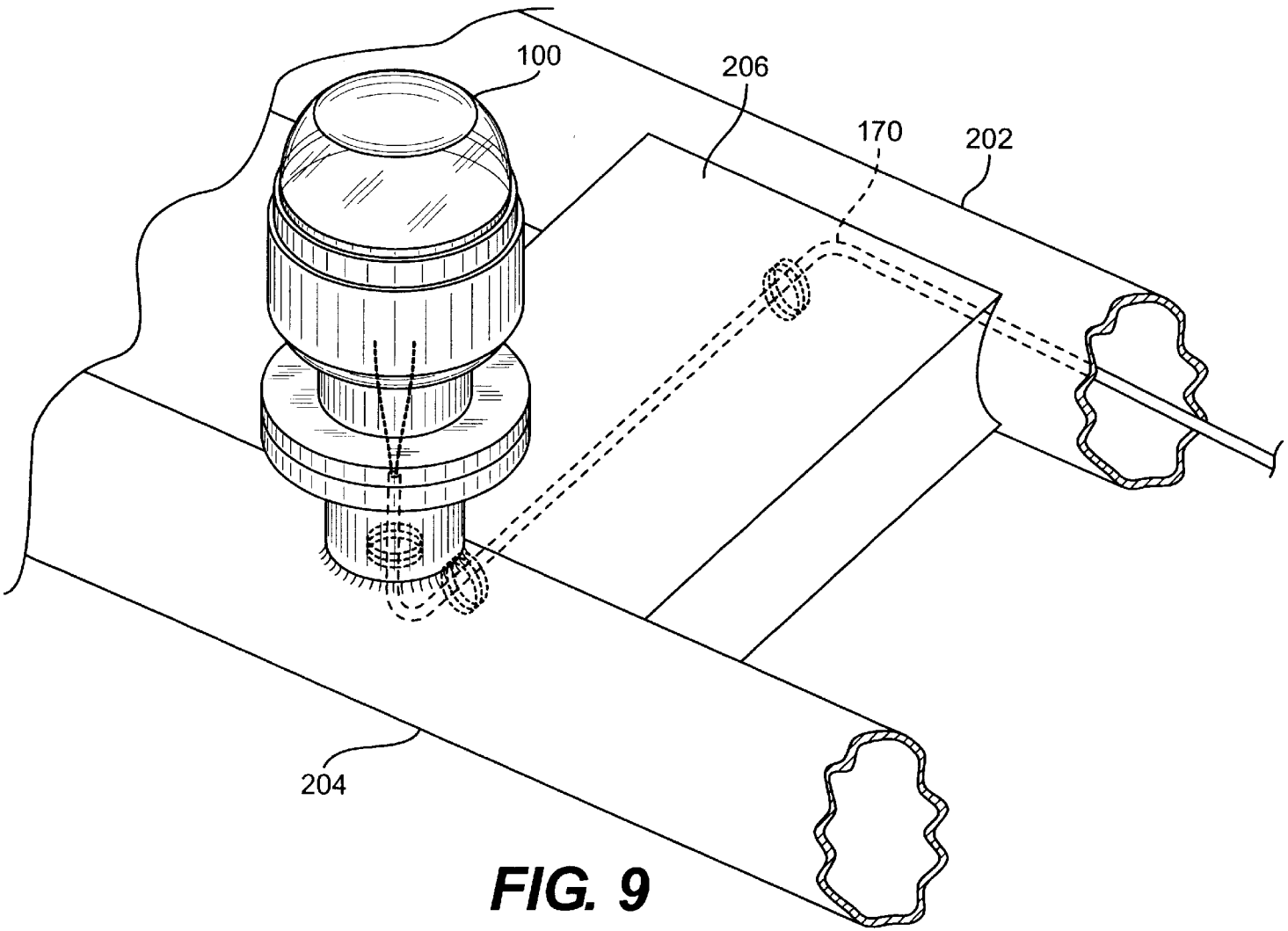
FIG. 9 is a partially cut-away, perspective view of the light and tow-line-attachment assembly, showing in further detail how the assembly is mounted to the tower.

As shown in FIGS. 7–9, the light and tow-line-attachment assembly 100 is mounted atop the aft arch 204, above the fore and aft centerline of the boat. Preferably, the light and tow-line-attachment assembly 100 is welded to the tower 200. However, alternative means of mounting the assembly 100 to the tower 200 may also be used, such as bolts, rivets, or the like.

FIGS. 8 and 9 illustrate how the light and tow-line-attachment assembly 100 connects to a power supply within the boat 220. Insulated electrical wires 170 lead from the light portion 160 down through the central passageway in the neck portion 120 of the assembly 100. There is an opening in the aft arch 204 where the assembly 100 is mounted, through which the wires 170 pass into the interior of the aft arch 204. The wires 170 then run through the interior of one of the horizontal cross members 206 to the forward arch 202 and continue down the interior of the starboard leg thereof. The wires 170 exit the forward arch 202 through an opening (not shown) near the bottom of the starboard leg, and then enter the starboard base member 208 through a hole (not shown) therein. From there, the wires 170 run down the forward leg of the starboard base member 208 and into the interior of the boat hull where they connect to an electrical power supply (not shown). A toggle switch 172 is provided on the operator's console for turning the light on and off. As those skilled in the art will appreciate, other wiring paths can be selected, including running the wires through different tower members, or running the wires wholly or partly along the exterior of the tower.

The embodiments discussed above are representative of embodiments of the present invention and are provided for illustrative purposes only. They are not intended to limit the scope of the invention. Although specific configurations, structures, materials, etc., have been shown and described, such are not limiting. Modifications and variations are contemplated within the scope of the present invention, which is intended to be limited only by the scope of the accompanying claims.

We claim:

1. A boat structure for towing a water sports performer, comprising:

a vertical structure designed for mounting to a boat; and an integrated light and tow-line attachment assembly mounted atop the vertical structure, the light and tow-line-attachment assembly including (i) a tow-line-attachment portion to which a tow line can be connected for towing a water sports performer, and (ii) a light portion, disposed above the tow-line-attachment portion and integrated into the same assembly as the tow-line-attachment portion, for emitting navigation light.

2. The boat structure of claim 1, wherein the light and tow-line-attachment assembly is attached to the vertical structure by a weld joint.

3. The boat structure of claim 1, wherein the tow-line-attachment portion of the light and tow-line-attachment assembly has a central, generally vertical passageway therethrough, and electrical wires for supplying power to the light portion run through that passageway.

4. The boat structure of claim 3, wherein the structure is a tower comprising a plurality of interconnected tubular members, and the electrical wires run through at least some of the tubular members.

5. The boat structure of claim 1, wherein the light portion of the light and tow-line-attachment assembly is substantially hemispherical in shape.

6. The boat structure of claim 1, wherein the light portion and the tow-line-attachment portion of the light and tow-line-attachment assembly are coaxially aligned with each other.

7. The boat structure of claim 1, wherein the light and tow-line-attachment assembly further comprises a neck portion that connects the assembly to the vertical structure, and the tow-line-attachment portion is a spool-shaped sleeve that is rotatably mounted about the neck portion.

8. The boat structure of claim 7, wherein the neck portion of the light and tow-line-attachment assembly is constructed of one or more metals selected from the group consisting of aluminum, stainless steel, and titanium alloys, and the sleeve is constructed of a synthetic resin selected from the group consisting of acetal resins, polytetrafluoroethylene, and nylon.

9. The boat structure of claim 1, wherein the structure is a tower comprising a plurality of arches joined by at least one cross member, and the light and tow-line-attachment assembly is mounted on a horizontal section of one of the arches.

10. The boat structure of claim 1, wherein the structure is a tower comprising forward and aft arches joined by at least one cross member, and the light and tow-line-attachment assembly is mounted on a horizontal section of the aft arch.

11. The boat structure of claim 4, wherein the light portion and the tow-line-attachment portion of the light and tow-line-attachment assembly are coaxially aligned with each other.

12. The boat structure of claim 11, wherein the light and tow-line-attachment assembly further comprises a neck portion that connects the assembly to the vertical structure, and the tow-line-attachment portion is a spool-shaped sleeve that is rotatably mounted about the neck portion.

13. The boat structure of claim 12, wherein the vertical structure comprises a plurality of arches joined by at least one cross member, and the light and tow-line-attachment assembly is mounted on a horizontal section of one of the arches.

14. The boat structure of claim 12, wherein the vertical structure comprises forward and aft arches joined by at least one cross member, and the light and tow-line-attachment assembly is mounted on a horizontal section of the aft arch.

15. The boat structure of claim 14, wherein the neck portion of the light and tow-line-attachment assembly is constructed of one or more metals selected from the group consisting of aluminum, stainless steel, and titanium alloys, and the sleeve is constructed of a synthetic resin selected from the group consisting of acetal resins, polytetrafluoroethylene, and nylon.

16. A boat for towing a water sports performer, the boat having a fore and aft centerline and comprising:

a hull including a bow, a stern, and port and starboard sides; and a tower mounted to the hull, the tower including an integrated light and tow-line-attachment assembly mounted thereon, above the boat's fore and aft centerline, the light and tow-line-attachment assembly including (i) a tow-line-attachment portion to which a tow line can be connected for towing a water sports performer, and (ii) a light portion, disposed above the tow-line attachment portion and integrated into the same assembly as the tow-line-attachment portion, for emitting navigation light.

17. The boat of claim 16, further comprising an operator's console disposed at a location between the bow and the stern, wherein the tower is mounted to the hull such that the tower extends substantially above the operator's console.

18. The boat of claim 16, wherein the tower is mounted to the sides of the boat.

19. The boat of claim 16, wherein the light and tow-line-attachment assembly is attached to the tower by a weld joint.

20. The boat of claim 16, wherein the tow-line-attachment portion of the light and tow-line-attachment assembly has a central, generally vertical passageway therethrough, and electrical wires for supplying power to the light portion run through that passageway.

21. The boat of claim 20, wherein the tower comprises a plurality of interconnected tubular members, and the electrical wires run through at least some of the tubular members.

22. The boat of claim 16, wherein the light portion of the light and tow-line-attachment assembly is substantially hemispherical in shape.

23. The boat of claim 16, wherein the light portion and the tow-line-attachment portion of the light and tow-line-attachment assembly are coaxially aligned with each other.

24. The boat of claim 16, wherein the light and tow-line-attachment assembly further comprises a neck portion that connects the assembly to the vertical structure, and the tow-line-attachment portion is a spool-shaped sleeve that is rotatably mounted about the neck portion.

25. The boat of claim 24, wherein the neck portion of the light and tow-line-attachment assembly is constructed of one or more metals selected from the group consisting of aluminum, stainless steel, and titanium alloys, and the sleeve is constructed of a synthetic resin selected from the group consisting of acetal resins, polytetrafluoroethylene, and nylon.

26. The boat of claim 16, wherein the tower comprises a plurality of arches joined by at least one cross member, and the light and tow-line-attachment assembly is mounted on a horizontal section of one of the arches.

27. The boat of claim 16, wherein the tower comprises forward and aft arches joined by at least one cross member, and the light and tow-line-attachment assembly is mounted on a horizontal section of the aft arch.

28. The boat of claim 27, wherein the forward and aft arches and the at least one cross member of the tower are hollow, the hollow interiors of the arches and the cross member are interconnected, and the aft arch includes a hole through which electrical wires for supplying power to the light portion of the light and tow-line-attachment assembly enter the hollow interior of the aft arch, and the wires then run through the cross member to the interior of the forward arch and down the inside of a leg of the forward arch, en route to a power source within the boat.

29. The boat of claim 28, wherein the light portion and the tow-line-attachment portion of the light and tow-line-attachment assembly are coaxially aligned with each other.

* * * * *